US007388460B2

(12) United States Patent
Hoffman

(10) Patent No.: US 7,388,460 B2
(45) Date of Patent: Jun. 17, 2008

(54) SOLENOID ACTUATOR

(75) Inventor: Lawrence Andrew Hoffman, Portland, OR (US)

(73) Assignee: The Hoffman Group International, Ltd., Portland, OR (US)

( * ) Notice: Subject to any disclaimer, the term of this patent is extended or adjusted under 35 U.S.C. 154(b) by 102 days.

(21) Appl. No.: 10/922,395

(22) Filed: Aug. 19, 2004

(65) Prior Publication Data

US 2005/0093662 A1 May 5, 2005

Related U.S. Application Data

(60) Provisional application No. 60/518,478, filed on Nov. 4, 2003.

(51) Int. Cl.
*H01F 3/00* (2006.01)
*H01F 7/08* (2006.01)

(52) U.S. Cl. ..... 335/219; 335/219; 335/255; 335/261; 335/279

(58) Field of Classification Search ..... 335/219, 335/255, 261, 279
See application file for complete search history.

(56) References Cited

U.S. PATENT DOCUMENTS

| | | | | |
|---|---|---|---|---|
| 795,340 | A * | 7/1905 | Carichoff | 335/133 |
| 3,119,954 | A * | 1/1964 | Bachi | 335/262 |
| 3,152,289 | A * | 10/1964 | Panfilo | 335/251 |
| 2002/0053803 | A1 * | 5/2002 | Kuntz et al. | 292/144 |

* cited by examiner

*Primary Examiner*—Ramon M Barrera
(74) *Attorney, Agent, or Firm*—Berkeley Law & Technology Group, LLP; Paul J. Fordenbacher, Esq.

(57) ABSTRACT

A plunger for use with a solenoid having a winding defining a bore is provided in an embodiment in accordance with the present invention, comprising a plunger first end, a plunger second end opposite the plunger first end, and a plurality of through-holes defining eyelets disposed in the plunger second end. The plunger first end is adapted to extend within the bore and the plunger second end adapted to extend from the bore. The eyelets are adapted to accept a cable therethrough. In another embodiment, the eyelets are substantially the same size, substantially equally spaced and substantially collinear. In another embodiment, the eyelets are in a staggered arrangement. In another embodiment, the plunger first end comprises a retention portion adapted to couple with a suitable coupler adapted to retain the plunger first end within a bore of a solenoid.

2 Claims, 8 Drawing Sheets

SOLENOID ACTUATOR

RELATED APPLICATIONS

This invention claims the benefit of co-pending U.S. Provisional Application No. 60/518,478, entitled "SOLENOID ACTUATOR", filed Nov. 4, 2003, the entire disclosure of which is hereby incorporated by reference as if set forth in its entirety for all purposes.

FIELD OF THE INVENTION

This invention generally relates to solenoid actuators, and more particularly, solenoid actuators for use in powering mechanisms on motor vehicles.

BACKGROUND

Power-driven components are becoming commonplace in motor vehicles as customers demand comfort and convenience. Power-actuated door latches and locks, hood releases, trunk openers, fuel-door openers, and hatches, for example, are either standard or optional equipment on many of today's cars and trucks. Customers looking to enhance their existing, non-powered equipment commonly turn to aftermarket components for conversion to power-driven equipment.

FIG. 1 is a schematic representation of a common solenoid actuator 5 known in the art for engaging a starter motor 6 with an engine 7. The solenoid actuator 5 includes a solenoid 2 and a plunger 13. The plunger 13 is coupled to a shift lever mechanism 8 that is linked to the starter motor 6. Electrical activation of the solenoid 2 linearly translates the plunger 13 which moves the shift lever mechanism 8 to move a drive component 9 of the starter motor 6 into engagement with a flywheel of the engine 7. When electrical energy is removed from the solenoid 2, the plunger 13 returns to a first position by the urging of a return spring 15 disengaging the drive component 9 from the engine 7.

The linear motion of the plunger 13 can be used to power other mechanisms that are normally manually operated from a first position to a second position. Examples of these other mechanisms include the opening/closing and locking/unlocking of door latches, hood releases, trunk openers, fuel-door openers, and hatches.

The solenoid actuator 2 coverts electrical energy to linear motion. FIG. 2 is a schematic representation of a common solenoid actuator 5, such as a starter or plunger-pulling solenoid actuator. The solenoid actuator 5 comprises a solenoid 2 and a plunger 13. The solenoid 2 includes a coil 1 which is a winding of wire defining a bore 3 adapted to accept the plunger 13. The plunger 13 is a magnetically-conductive elongated member, such as, but not limited to, an iron rod. At least a portion of the plunger 13 is received within the bore 3. The coil 1 is electrically energized by passing a current through the coil 1 which creates electromagnetic forces within the bore 3. The electromagnetic forces linearly translate the plunger 13 from a first position to a second position. Accordingly, when energized, the coil 1 generates a pulling force so that the plunger 13 is moved in the axial direction in a short period of time. A return spring (not shown) is coupled to the plunger 13 so as to urge the plunger 13 back into the first position after the current is removed.

FIG. 3 is a perspective view of a known pull-type solenoid actuator 10. The solenoid actuator 10 comprises a solenoid 2 including a cylindrical housing 11 that comprises the coil (not shown) defining a bore 3. Extending from the bore 3 is a plunger 13. The plunger 13 includes a plunger first end 17 that extends in the bore 3 and a plunger second end 18 that extends out of the bore 3. The plunger second end 18 includes an eyelet 14 which is a through-hole. The eyelet 14 is adapted to accept a hook-end of a lever, such as the shift lever of FIG. 1. A single eyelet 14 is not ideal for accepting a cable as will be discussed below.

FIG. 4 is a perspective view of a latching mechanism 50 coupled to a solenoid plunger 13 by a cable 30. The latching mechanism 50 comprises a lever 52, a pivot 54, a lever head 56, a restoring spring 55, and a locking notch device 58. The solenoid actuator 10 pulls the cable 30 that is coupled to the lever 52 to disengage the lever head 56 from the locking-notch device 58. Examples of latching mechanisms 50 include, but are not limited to, vehicle trunk lid latches, hood latches, and door latches. The solenoid actuator 10 provides remote operation of the respective latching mechanism 50. The solenoid actuator 10 is electrically energized by activating an electrical switch, such as a switch mounted in the cabin, or a button on a hand-held remote control transmitter, for example.

Known solenoid actuators 10 have a single eyelet 14 which are adapted to engage a hook on a lever, rather than adapted for use with a cable 30. This causes a number of significant problems in using solenoid actuators 10 for pulling a cable 30. One significant problem is that a single eyelet 14 does not provide the necessary adjustability for use as a cable-pulling device. This is particularly so when the solenoid actuator 10 is part of a conversion kit for hobbyist to install on their motor vehicles. A single eyelet 14 provides only a few choices for coupling the cable 30 to the plunger 13. FIG. 4 shows a crimping tab 32 coupled to the cable proximal end 31 of the cable 30 that extends through the eyelet 14. The crimping tab 32 is larger than the eyelet 14 and thus cannot pass through the eyelet 14 retaining the cable proximal end 31 to the plunger 13.

The crimping tab 32 is only as secure as the grip it has on the cable proximal end 31. The strong pull of the plunger 13 over many cycles puts much stress on the crimping tab 32 leading to eventual slippage and failure. Considering that the length of the cable 30 is unique and determined by the specific application, the crimping tab 32 is coupled to the cable proximal end 31 by the installer. Lack of skill in assembly will also contribute to premature failure of the crimping tab 32.

FIG. 3 shows another configuration for coupling the cable 30 to the plunger 13. The cable proximal end 31 is formed into a loop 35 with the crimping tab 32 coupled to the cable proximal end 31 and to another portion of the cable 30. Forming a loop 35 in the cable proximal end 31 provides an easier assembly for the installer. Crimping the crimping tab 32 onto another portion of the cable 30 may relieve some of the stress on the crimping tab 32 as compared with the crimp shown in FIG. 4.

In application, the looped cable proximal end 31 is problematic over time. After a number of cycles, the loop 35 stretches and enlarges. This not only causes the cable 30 to slacken, but also interferes with proper function. An oversized loop 35 can shift in the eyelet 14. FIG. 5 illustrates a loop 35 having turned retrograde in the eyelet 14. This causes the cable 30 to shorten significantly usually resulting in the latching mechanism 50, such as shown in FIG. 4, remaining in the open position. Disassembly of a motor vehicle body panel and retightening of the cable 30 is usually required to remedy the failure.

It is desired in the art to have a solenoid actuator for use in pulling a cable that addresses the problems associated with currently-available solenoid actuators. It is desired to provide a solenoid actuator that allows for greater adjustability for coupling a cable to the plunger. Further, it is desired to provide a solenoid actuator that overcomes the problem of a cable loop becoming retrograde preventing operation of the attached mechanism. Further, there is a need for a solenoid actuator that is easy to install, regardless of the application. There is also a need to reduce specialization of solenoid actuators, providing more universal designs which results in lower costs per unit, greater flexibility in the number of applications, and improved economies of scale for the manufacturer.

SUMMARY

A solenoid actuator is provided in an embodiment in accordance with the present invention, comprising a solenoid including a winding defining a bore, and a plunger including a plunger first end, a plunger second end opposite the plunger first end, and a plurality of through-holes defining eyelets disposed in the plunger second end, the plunger first end slidingly received within the bore and the plunger second end extending from the bore, the eyelets adapted to accept a cable therethrough. In another embodiment, the solenoid actuator includes eyelets that are substantially the same size, substantially equally spaced and substantially collinear. In another embodiment, the solenoid actuator includes eyelets that are in a staggered arrangement. In another embodiment, the plunger first end comprises a retention portion adapted to couple with a suitable coupler adapted to retain the plunger first end within the bore.

A plunger for use with a solenoid having a winding defining a bore is provided in an embodiment in accordance with the present invention, comprising a plunger first end, a plunger second end opposite the plunger first end, and a plurality of through-holes defining eyelets disposed in the plunger second end. The plunger first end is adapted to extend within the bore and the plunger second end adapted to extend from the bore. The eyelets are adapted to accept a cable therethrough. In another embodiment, the eyelets are substantially the same size, substantially equally spaced and substantially collinear. In another embodiment, the eyelets are in a staggered arrangement. In another embodiment, the plunger first end comprises a retention portion adapted to couple with a suitable coupler adapted to retain the plunger first end within a bore of a solenoid.

A power latching device is provided in an embodiment in accordance with the present invention, comprising a latch assembly, a cable having a cable proximal end and an opposite cable distal end, the cable proximal end coupled to the latch assembly at a cable proximal end, and a solenoid actuator comprising a solenoid including a winding defining a bore and a plunger including a plunger first end, a plunger second end opposite the plunger first end, and a plurality of through-holes defining eyelets disposed in the plunger second end. The plunger first end is disposed within the bore and the plunger second end extends from the bore. The eyelets are adapted to accept the cable distal end therethrough. The cable is coupled to the plunger. In another embodiment, the plunger first end comprises a retention portion adapted to couple with a suitable coupler adapted to retain the plunger first end within the bore.

An adapter for a solenoid plunger having a plunger eyelet is provided in an embodiment in accordance with the present invention, comprising a sleeve comprising a plurality of through-holes defining a plurality of sleeve eyelets. The sleeve having a cavity adapted to accept at least a portion of the plunger second end therein. The sleeve eyelets are adapted to align in cooperative alignment with the plunger eyelet. The sleeve eyelets are adapted to accept a cable therethrough. In another embodiment, the adapter further comprises a fastener adapted to couple the sleeve to the plunger.

An adapter for a solenoid plunger is provided in an embodiment in accordance with the present invention, comprising a sleeve comprising a plurality of through-holes defining a plurality of sleeve eyelets. The sleeve having a cavity that is adapted to accept at least a portion of the plunger therein. The sleeve eyelets are adapted to extend beyond the plunger and adapted to accept a cable therethrough. In another embodiment, the sleeve further comprises a fastener adapted to couple the sleeve to the plunger.

A method of using a solenoid actuator is provided in an embodiment in accordance with the present invention, comprising providing a solenoid actuator comprising a winding defining a bore and a plunger including a plunger first end, a plunger second end opposite the plunger first end, and a plurality of through-holes defining eyelets disposed in the plunger second end. The plunger first end is disposed within the bore and the plunger second end extending from the bore. The eyelets are adapted to accept a cable therethrough. The cable distal end of a cable is extended through at least one eyelet and the cable distal end is coupled to the plunger. In another embodiment, extending a cable distal end of a cable through at least one eyelet and coupling the cable distal end to the plunger comprises extending a cable distal end of a cable through one eyelet from a plunger first side through to a plunger second side opposite the plunger first side and coupling the cable distal end adjacent the plunger second side so as to prevent the cable distal end from disengaging the plunger. In another embodiment, extending a cable distal end of a cable through at least one eyelet and coupling the cable distal end to the plunger comprises extending a cable distal end of a cable through one eyelet from a plunger first side through to a plunger second side opposite the plunger first side and coupling a fastener on the cable distal end adjacent the plunger second side so as to prevent the cable distal end from disengaging the plunger.

In another embodiment, extending a cable distal end of a cable through at least one eyelet comprises extending a cable distal end of a cable through at least two eyelets. In another embodiment, extending a cable distal end of a cable through at least one eyelet comprises weaving a cable distal end of a cable through at least two eyelets. In another embodiment, extending a cable distal end of a cable through at least one eyelet and coupling the cable distal end to the plunger comprises extending a cable distal end of a cable through at least two eyelets and coupling a fastener on the cable distal end adjacent the plunger second side so as to prevent the cable distal end from disengaging the plunger.

In another embodiment, extending a cable distal end of a cable through at least one eyelet and coupling the cable distal end to the plunger comprises extending a cable distal end of a cable through at least two eyelets, forming the cable distal end into a loop that includes a portion of the cable distal end that is within the at least two eyelets, and coupling the cable distal end and a portion of the cable to secure the loop and prevent the cable distal end from disengaging the plunger. In another embodiment, extending a cable distal end of a cable through at least one eyelet and coupling the cable distal end to the plunger comprises extending a cable distal end of a cable through at least two eyelets, forming the cable distal end into a loop that includes a portion of the cable distal end that is within the at least two eyelets, and coupling a fastener on the cable distal end and a portion of the cable to secure the loop and prevent the cable distal end from disengaging the plunger.

A method of using a solenoid actuator is provided in an embodiment in accordance with the present invention, comprising providing a solenoid actuator comprising a winding defining a bore and a plunger including a plunger first end, a plunger second end opposite the plunger first end, and through-holes defining a plunger eyelet disposed in the plunger second end. The plunger first end is disposed within the bore and the plunger second end extends from the bore. A sleeve is provided comprising a plurality of through-holes defining a plurality of sleeve eyelets, the sleeve having a cavity adapted to accept at least a portion of the plunger second end therein, the sleeve eyelets are adapted to align in cooperative alignment with the plunger eyelet, the sleeve eyelets adapted to accept a cable therethrough. A cable distal end of a cable is extended through at least one sleeve eyelet and coupled to the sleeve.

A method of using a solenoid actuator is provided in an embodiment in accordance with the present invention, comprising providing a solenoid actuator comprising a winding defining a bore and a plunger including a plunger first end, a plunger second end opposite the plunger first end, the plunger first end disposed within the bore and the plunger second end extending from the bore. A sleeve is provided comprising a plurality of through-holes defining a plurality of sleeve eyelets, the sleeve having a cavity that is adapted to accept at least a portion of the plunger second end therein, the sleeve eyelets extending beyond the plunger second end and adapted to accept a cable therethrough. At least a portion of the plunger second end is disposed into the cavity and coupled to the plunger second end. A cable distal end of a cable is extended through at least one sleeve eyelet and coupled to the sleeve.

A power assembly for use in a vehicle having a lever, a lever head, a restoring spring, and a latching mechanism is provided in an embodiment in accordance with the present invention, comprising a cable having a cable proximal end and a cable distal end, a winding defining a bore, and a plunger comprising an elongated rod having a plunger first end and an opposite plunger second end, the plunger first end adapted to be slidingly received within the bore, the plunger second end extending from the bore, the plunger second end including a plurality of through holes, each through hole defining an eyelet adapted to accept the cable proximal end therethrough. The cable proximal end is threaded through at least one through hole and coupled to the plunger. The cable distal end is coupled to the lever. The winding is adapted to, when energized, position the plunger in a first position to cause cable tension to pull on the lever to disengage the lever head from the latching mechanism, and when not energized, position the plunger in a second position to release cable tension and enable a restoring spring to engage the lever head with the latching mechanism.

The foregoing is not intended to be a limiting description of the invention as persons skilled in the art are capable of appreciating other embodiments and features for the following detailed description in conjunction with the drawings.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Embodiments of the present invention provide a solenoid plunger for a solenoid actuator having a plurality of eyelets that overcome the problems and issues associated with plungers having a single eyelet. The following detailed description describes a particular type of solenoid actuator. It is understood that other types of solenoid actuators, having other specific means for moving a plunger, and other modes of operation, such as, but not limited to pull-type, push-type and hold-type, are particularly suitable for embodiments of the plunger of the present invention. Therefore, the following detailed description is not to be taken in a limiting sense, and the scope of the present invention is defined by the appended claims and their equivalents.

Embodiments of the present invention further discussed below provide the use of a crimping tab to secure a cable distal end of a cable to the plunger. It is understood that those in the art will recognize that there are many types of methods and fasteners that can be used to secure the cable distal end to the plunger as well as to form and secure a loop in the cable distal end. Examples of suitable methods include, but are not limited to, tying one or more knots in the cable distal end. Examples of suitable fasteners include, but are not limited to, the mentioned crimping tab, a screw clamp, a spring clip, and a nut and bolt assembly. Therefore, the following detailed description is not to be taken in a limiting sense, and the scope of the present invention is defined by the appended claims and their equivalents.

Figure 6:
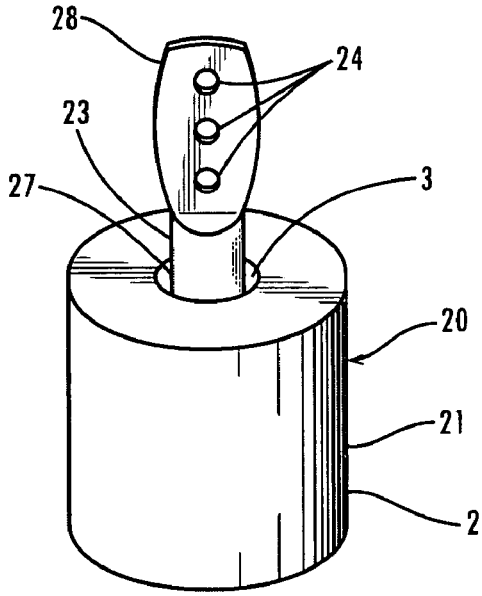
FIG. 6 is a perspective view of a solenoid actuator in accordance with an embodiment of the present invention.

FIG. 6 is a perspective view of a solenoid actuator 20 in accordance with an embodiment of the present invention. The solenoid actuator 20 comprises a solenoid 2 defining a bore 3 and a plunger 23 including a plunger first end 27 that extends into the bore 3 and a plunger second end 28 that extends from the bore 3. The plunger second end 28 comprises a plurality of eyelets 24. The eyelets 24 are apertures, or through-holes through which a cable can be pulled. In the embodiment shown in FIG. 6 the three eyelets 24 are substantially the same size, substantially equally spaced and substantially collinear. In other embodiments of the present invention, there is more or less number of eyelets 24 and they are not necessarily of the same size, equally spaced, nor collinear.

Figure 4:
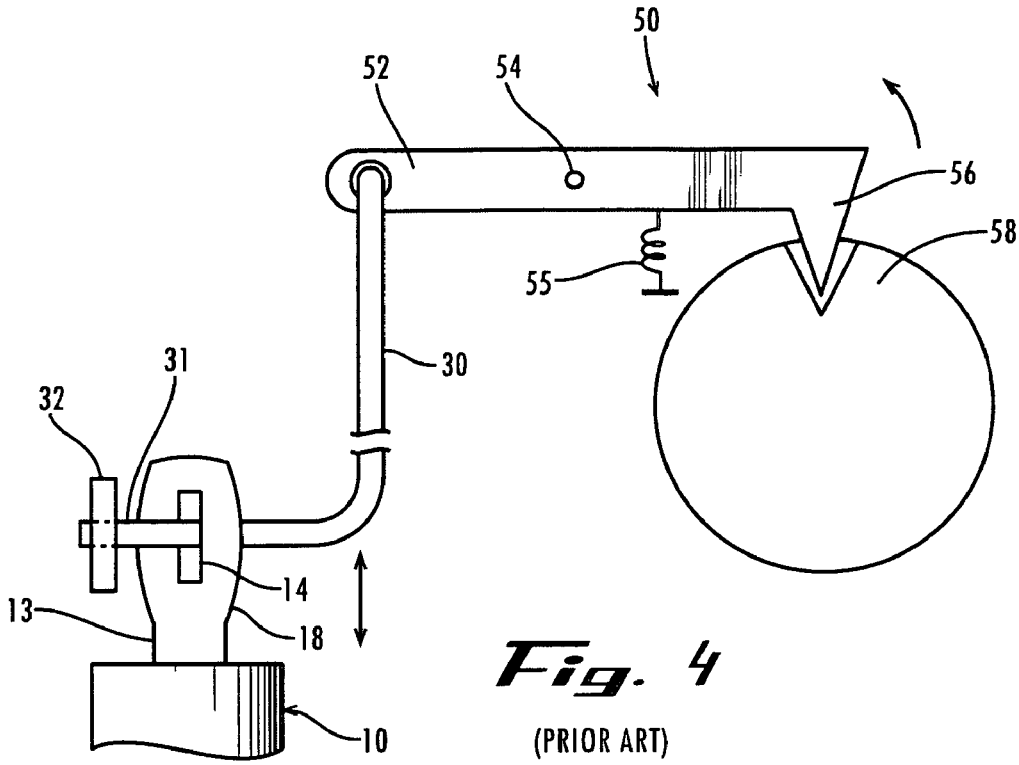
Fig. 4 (PRIOR ART)
FIG. 4 is a perspective view of a latching mechanism coupled to a solenoid plunger by a cable.
Figure 7:
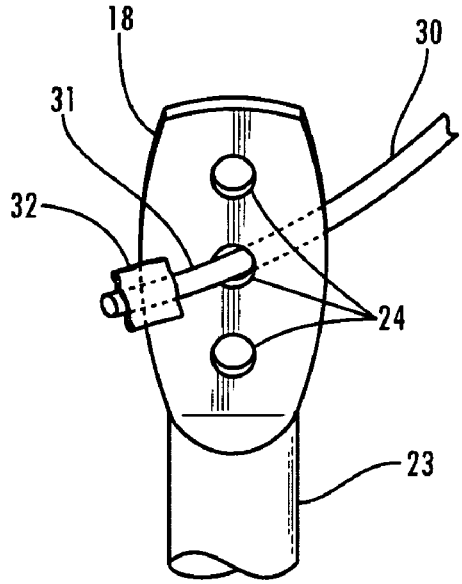
FIG. 7 is a front view of the plunger second end of the plunger of the embodiment of FIG. 6 showing a method of use, in accordance with an embodiment of the present invention.

FIG. 7 is a front view of the plunger second end 18 of the plunger 23 of the embodiment of FIG. 6 showing a method of use, in accordance with an embodiment of the present invention. A cable distal end 31 of the cable 30 is pulled through one of the plurality of eyelets 24 and crimped with a crimping tab 32. The crimping tab 32 prevents the pull-out or disengagement of the cable 30 from the eyelet 24. The crimping tab 32 is provided by way of example and any suitable fastener, tying, or other apparatus and methods for securing the cable 30 to the plunger 23 are anticipated. The plurality of eyelets 24 provides the installer with a choice of positions on the plunger 23 to attach the cable 30. This provides a greater degree of control when tensioning the cable 30 to a device, such as, but not limited to, a lever on a latch such as that shown in FIG. 4.

Figure 8A:
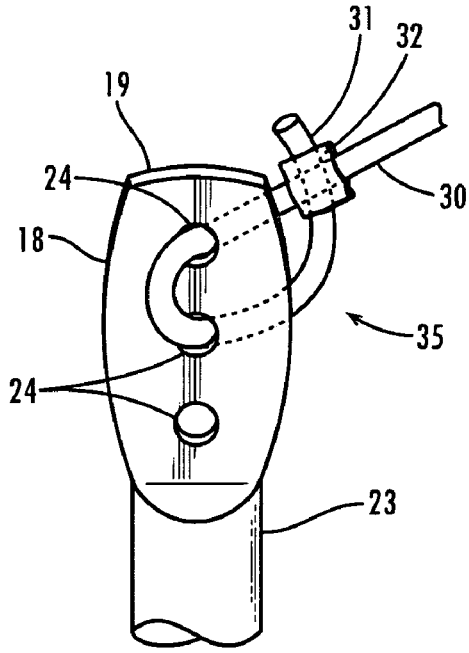
FIGS. 8A and 8B are front and side views, respectively, of the plunger second end of the plunger of the embodiment of FIG. 6 showing another method of use, in accordance with an embodiment of the present invention.
Figure 8B:
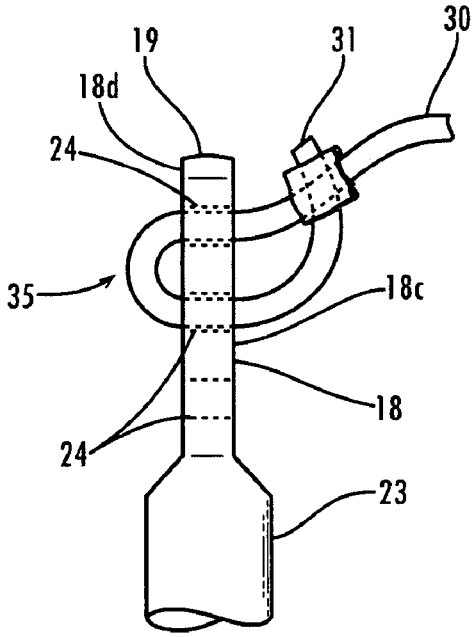

FIGS. 8A and 8B are front and side views, respectively, of the plunger second end 18 of the plunger 23 of the embodiment of FIG. 6 showing another method of use, in accordance with an embodiment of the present invention. Cable 30 is pulled through one of the plurality of eyelets 24 and pulled through another of the eyelets 24 to form a loop 35 that includes a portion of the cable distal end 31 that is within the eyelets 24. The cable distal end 31 is crimped with a crimping tab 32 on a portion of the cable 30. The loop 35 disposed through a plurality eyelets 24 helps to spread out some of the force on the cable 30 relieving some of the force on the crimping tab 32 and thus preventing the pull-out of the cable 30 from the crimping tab 32. The crimping tab 32 is provided by way of example and any suitable fastener, tying, or other apparatus and methods for securing the cable 30 to the plunger 23 are anticipated. The plurality of eyelets 24 provide the installer with a choice of positions on the plunger 23 to loop the cable 30 through. This provides a greater degree of control when tensioning the cable 30 to a device, such as, but not limited to, a lever on a latch such as that shown in FIG. 4.

Figure 1:
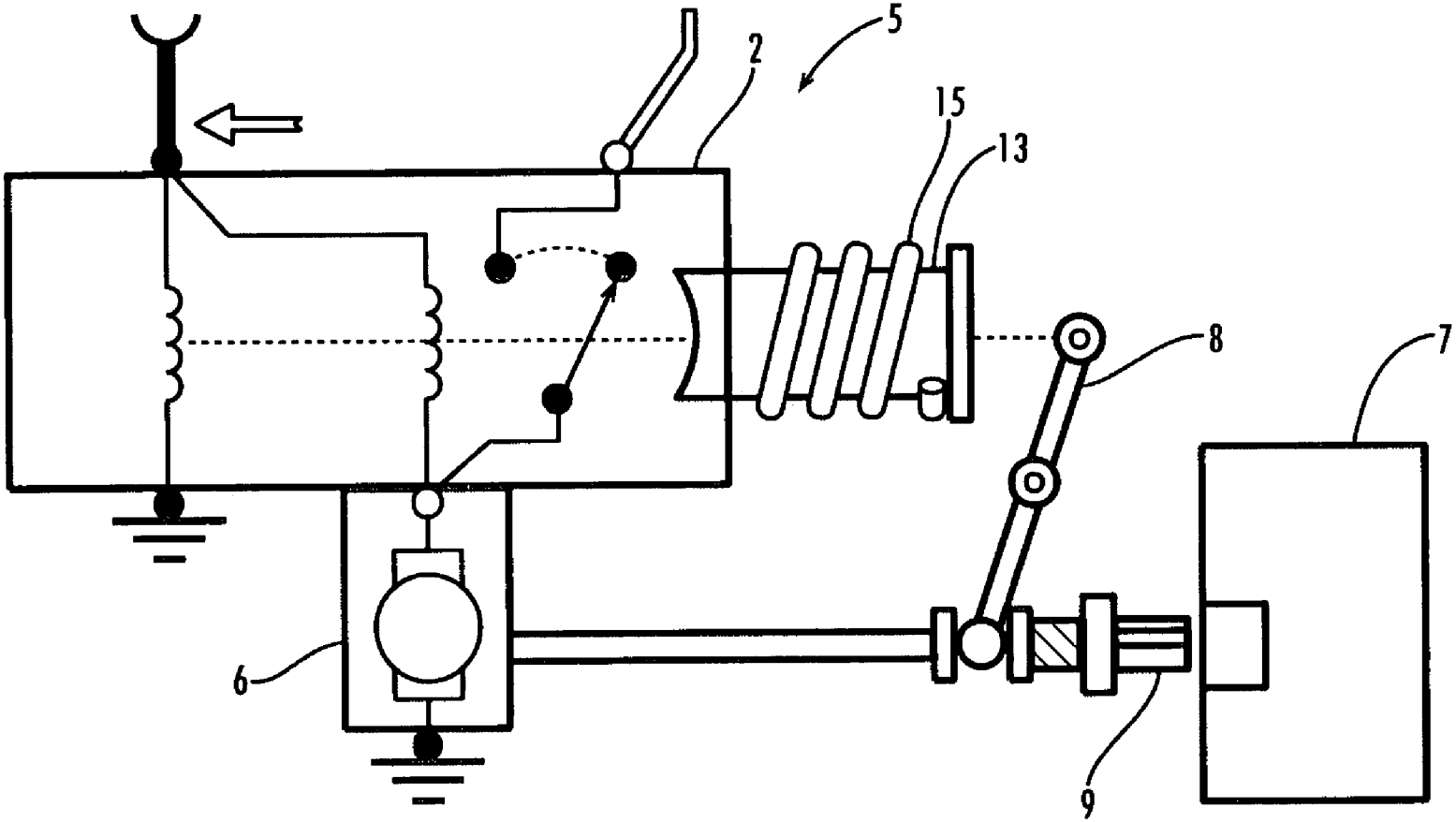
Fig. 1 (PRIOR ART)
FIG. 1 is a schematic representation of a common solenoid actuator known in the art for engaging a starter motor with an engine.
Figure 2:
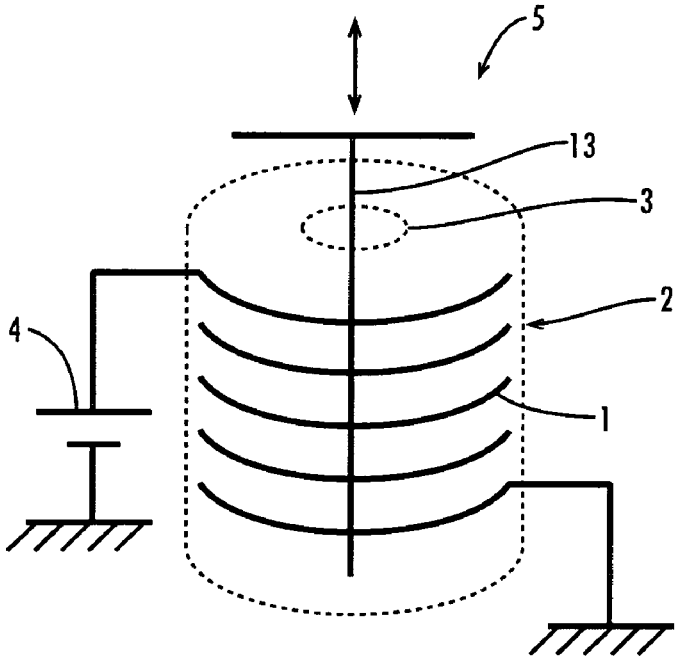
Fig. 2 (PRIOR ART)
FIG. 2 is a schematic representation of a common solenoid actuator, such as a starter or plunger-pulling solenoid actuator.
Figure 3:
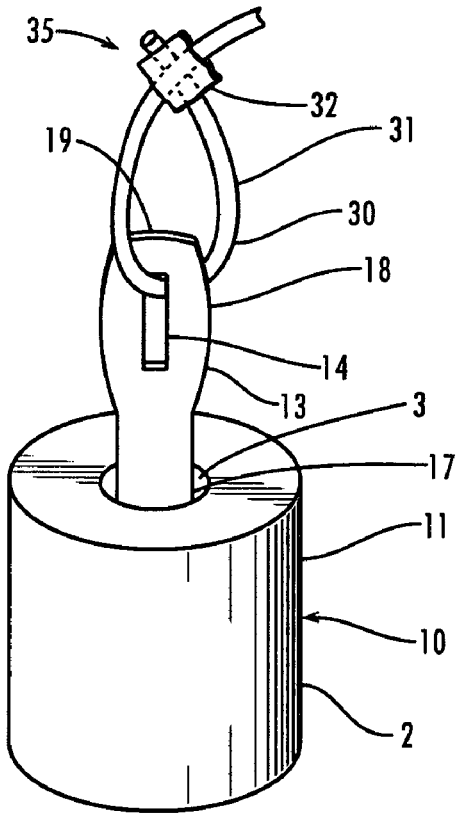
Fig. 3 (PRIOR ART)
FIG. 3 is a perspective view of a known plunger-type solenoid actuator.
Figure 5:
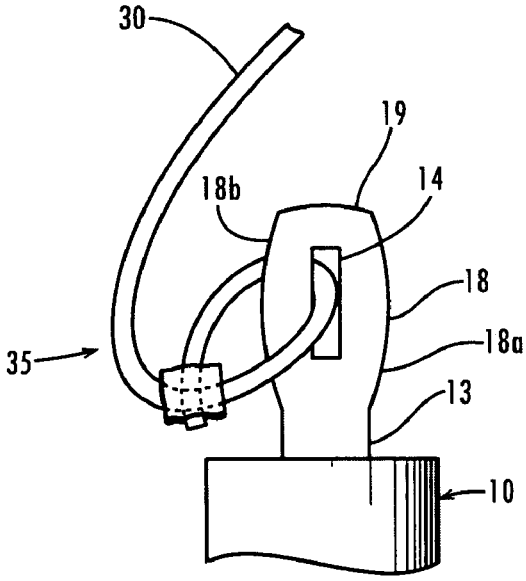
Fig. 5 (PRIOR ART)
FIG. 5 illustrates a loop having turned retrograde in the eyelet.

The ability of looping the cable 30 through a plurality of eyelets 24 provides a significant unrealized benefit of substantially eliminating retrograde positioning of the loop 35, as compared to looping the cable 30 through a single eyelet 14 as shown in FIG. 3. Referring again to FIGS. 3 and 5, retrograde positioning of the loop 35 occurs for one or a combination of a number of factors, including the amount of slack in the cable 30 and therefore the loop 35, the size of the loop 35, the amount of movement of the cable 30 within the eyelet 14, among others. A loop 35 passing through one eyelet 14 is relatively free to move about the plunger distal tip 19 of the plunger 13. Where there is sufficient slack in the cable 30 and/or the loop 35 is too large, either due to stretching over time or improper tensioning when installed, among others, there is the possibility that the loop 35 can move from a plunger first side 18*a* of the plunger second end 18 to a plunger second side 18*b*. This side-to-side movement can cause the loop 35 to be positioned retrograde significantly shortening the overall length of the cable 30 causing failure in the operation of the mechanism attached to the cable 30.

Where the loop 35 can move within the eyelet 14, such as in the case where the cable 30 and the eyelet 14 is not substantially the same diameter or closely fitted, among others, there is the possibility that the loop 35 can move from the plunger first side 18*a* of the plunger second end 18 to the plunger second side 18*b* causing retrograde positioning of the loop 35 with substantially the same consequences as discussed above, as shown in FIG. 5.

Embodiments of the present invention substantially eliminate retrograde positioning of the loop 35. Referring again to FIGS. 8A and 8B, looping the cable distal end 31 through at least two eyelets 24 substantially eliminates the possibility that the loop 35 will traverse the plunger distal tip 19. The loop 35 remains on either a third side 18*c* or a forth side 18*d* of the plunger distal end 18 with little to no motivation to be caused to flip over the plunger distal tip 19. The loop 35 is therefore constrained to be in proper position preventing the loop 35 to be positioned retrograde and substantially eliminating malfunctioning of the operation of the assembly.

Looping the cable 30 through a plurality of eyelets 24 provides significant operational effectiveness, for being much more forgiving in circumstances wherein the loop 35 is caused to enlarge due to stretching over time or improper tensioning when installed, as compared to looping the cable 30 through a single eyelet 14 as shown in FIG. 3. The benefit is further realized as for providing a system being much more forgiving wherein the cable 30 and eyelets 24 are not substantially matched in size.

Figure 9A:
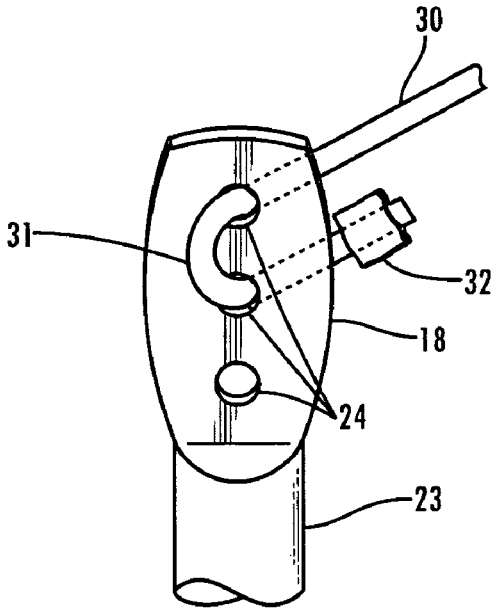
FIGS. 9A and 9B are front views of the plunger second end of the plunger of the embodiment of FIG. 6 showing other methods of use, in accordance with an embodiment of the present invention.
Figure 9B:
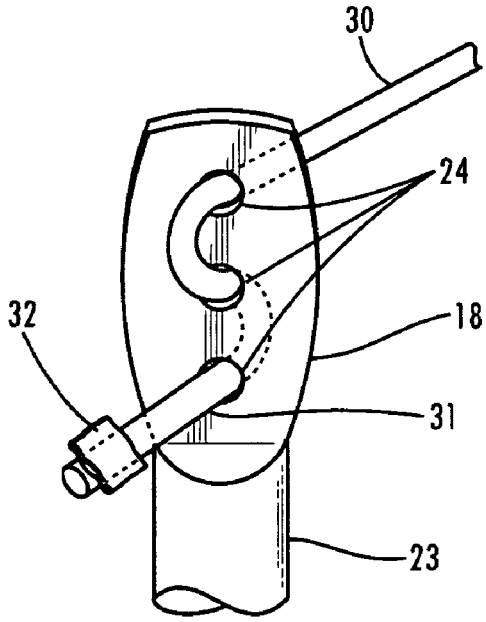

FIGS. 9A and 9B are front views of the plunger second end 18 of the plunger 23 of the embodiment of FIG. 6 showing other methods of use, in accordance with an embodiment of the present invention. Cable 30 is weaved through two or more eyelets 24 and crimped with a crimping tab 32 on a distal cable end 31 of the cable 30. The crimping tab 32 prevents the pull-out of the cable 30 from the eyelet 24 proximate the distal cable end 31. The weaving of the cable 30 through a plurality of eyelets 24 provides a more secure coupling of the cable 30 to the plunger 23. This provides a greater degree of control of the cable 31 to prevent slipping out of engagement with the crimping tab 32. The multiple turns in the cable 30 couples the cable 20 to the plunger 23 at multiple locations helping to relieve some of the tension on the crimping tab 32. The crimping tab 32 is provided by way of example and any suitable fastener, tying, or other apparatus and methods for securing the cable 30 to the plunger 23 are anticipated.

Figure 9C:
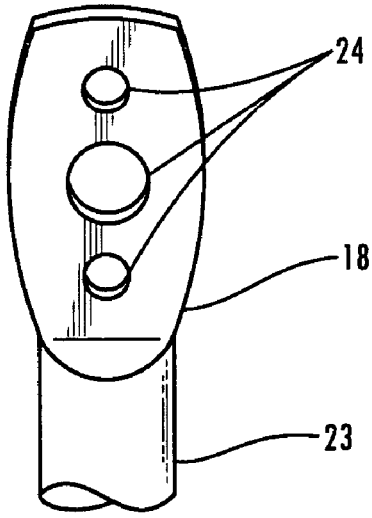
FIGS. 9C and 9D are front views of the plunger second end of the plunger showing other arrangements of the eyelets, in accordance with embodiments of the present invention.
Figure 9D:
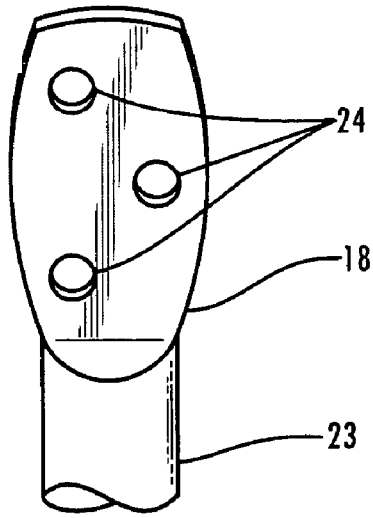

FIGS. 9C and 9D are front views of the plunger second end 18 of the plunger 23 showing other arrangements of the eyelets 24, in accordance with embodiments of the present invention. FIG. 9C shows eyelets 24 disposed on the plunger second end 18 having various sizes and shapes. FIG. 9D shows eyelets 24 disposed on the plunger second end 18 in a staggered arrangement.

Figure 10:
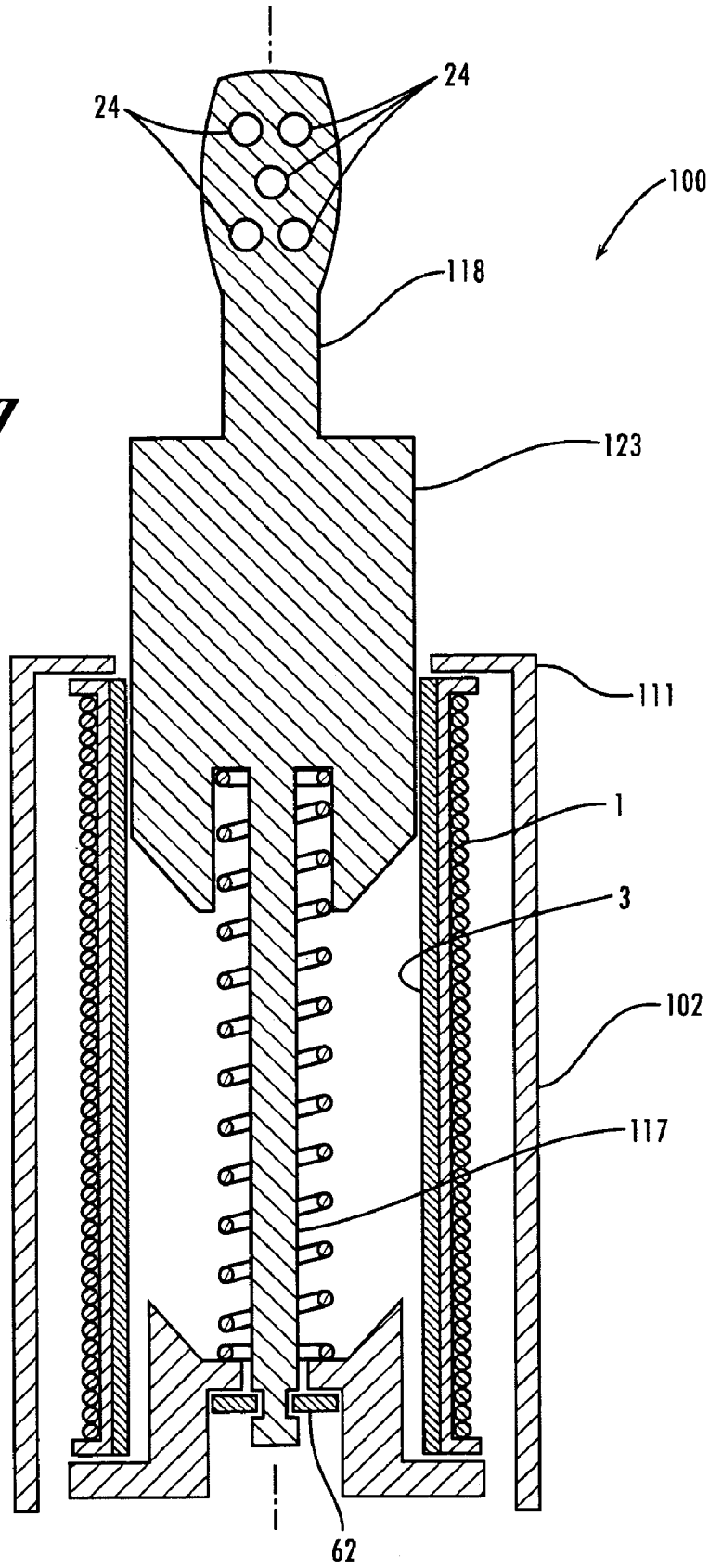
FIG. 10 is a front cross-sectional view of the solenoid in accordance with the embodiment of the present invention.

FIG. 10 is a front cross-sectional view of a solenoid actuator 100 in accordance with an embodiment of the present invention. The solenoid actuator 100 comprises a solenoid 102 including a cylindrical housing 111 that houses a coil 1 defining a bore 3. Partially disposed within the bore 3 is a plunger 123. The plunger 123 includes a plunger first end 117 that extends in the bore 3 and a plunger second end 118 that extends out of the bore 3. The plunger second end 118 includes a plurality of eyelets 24. The plurality of eyelets 24 is adapted to accept a cable therethrough. Engagement of the plunger 123 with the coil 1 is retained with a suitable coupler, such as a C-clip 62.

Figure 11A:
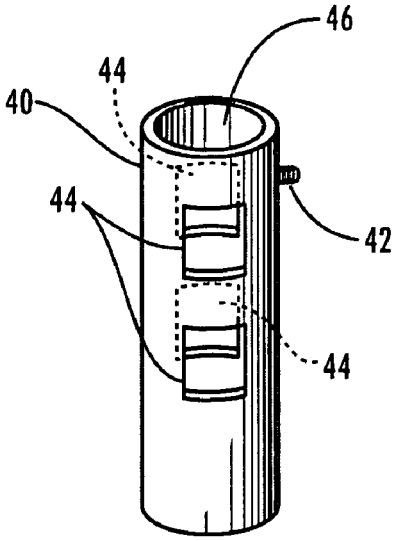
FIG. 11 A is a front view of an adaptor sleeve comprising a plurality of sleeve eyelets, in accordance with an embodiment of the present invention.
FIG. 11B is a front view of the plunger second end of the plunger having a single eyelet similar to the embodiment of FIG. 3, further comprising an adaptor sleeve comprising a plurality of sleeve eyelets, in accordance with an embodiment of the present invention.
Figure 11B:
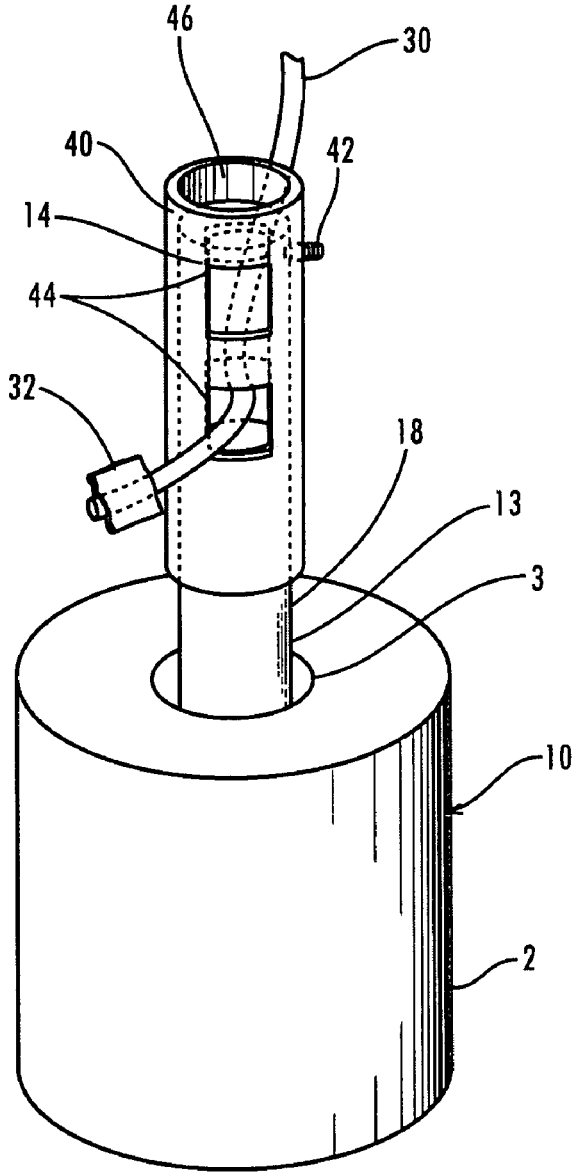

FIG. 11A is a front perspective view of an adaptor sleeve 40 comprising a plurality of sleeve eyelets 44, in accordance with an embodiment of the present invention. FIG. 11B is a front perspective view of the adaptor sleeve 40 coupled to the plunger second end 18 of the plunger 13 having a single eyelet 14 similar to the embodiment of FIG. 3. The adaptor sleeve 40 comprises a cavity 46 adapted to accept at least a portion of the plunger second end 18 therein. The adaptor sleeve 40 is coupled to the plunger 13 using suitable means, such as, but not limited to a set screw 42. The adaptor sleeve 40 adapts a plunger 13 having a single eyelet 14 into a plunger 13 having multiple eyelets 44. The sleeve eyelets 44 are adapted to align in cooperative alignment with the single eyelet 14 of the plunger 13. The sleeve eyelets 44 are adapted to accept a cable 30 there-through in substantially the same way as provided in the embodiments above.

Figure 12A:
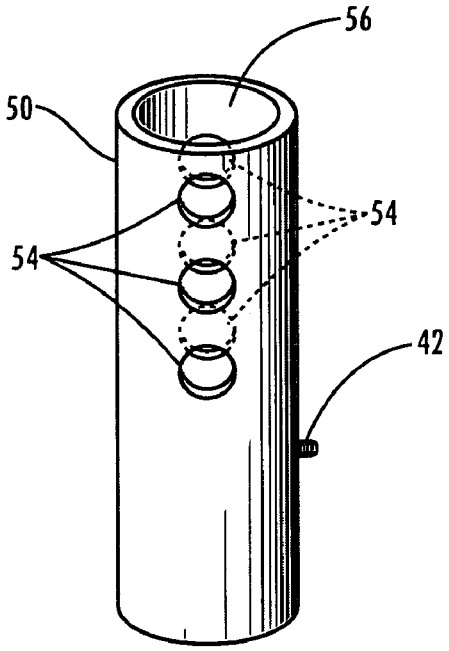
FIG. 12A is a front view of an extension sleeve comprising a plurality of sleeve eyelets, in accordance with another embodiment of the present invention.
Figure 12B:
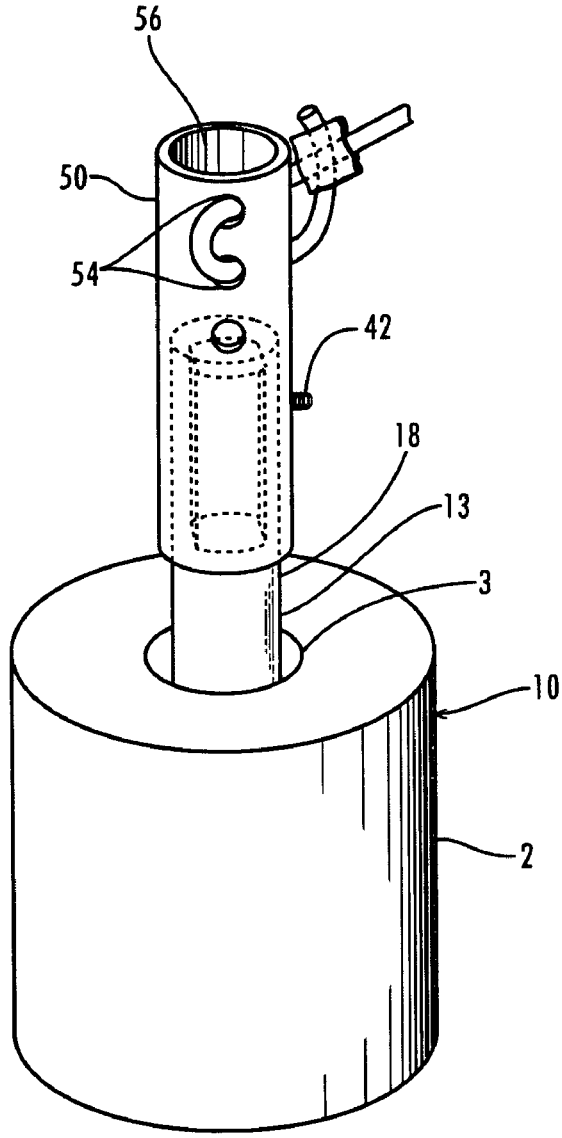
FIG. 12B is a front view of the plunger second end of the plunger having a single eyelet similar to the embodiment of FIG. 3, further comprising an extension sleeve comprising a plurality of sleeve eyelets, in accordance with an embodiment of the present invention.

FIG. 12A is a front perspective view of an extension sleeve 50 comprising a plurality of sleeve eyelets 54, in accordance with an embodiment of the present invention. FIG. 12B is a front perspective view of the extension sleeve 50 coupled to the plunger second end 18 of the plunger 13 having a single eyelet 14 similar to the embodiment of FIG. 3. The extension sleeve 50 comprises a cavity 56 adapted to accept at least a portion of the plunger second end 18 therein. The extension sleeve 50 is coupled to the plunger 13 using suitable means, such as, but not limited to a set screw 42. The extension sleeve 50 adapts a plunger 13 having a single eyelet 14 into a plunger 13 having multiple eyelets 54. The sleeve eyelets 54 are adapted to extend beyond the plunger second end 18. The sleeve eyelets 54 are adapted to accept a cable 30 therethrough in substantially the same way as provided in the embodiments above.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed is:

1. A power latching device, comprising:
- a latch assembly;
- a cable having a cable proximal end and an opposite cable distal end, the cable proximal end coupled to the latch assembly at a cable proximal end;
- a solenoid actuator comprising:
  - a solenoid including a winding defining a bore; and
  - a plunger including a plunger first end, a plunger second end opposite the plunger first end, and a plurality of through-holes defining eyelets disposed in the plunger second end, each through-hole defining an axis, each through-hole is not in coaxial alignment with another through-hole, the plunger first end disposed within the bore and the plunger second end extending from the bore, the eyelets adapted to accept the cable distal end therethrough, the cable coupled to the plunger.

2. The power latching device of claim 1, the solenoid actuator further comprising a coupler, wherein the plunger first end comprises a retention portion, the coupler coupled with the retention portion to retain the plunger first end within the bore.

* * * * *